US008397919B2

(12) United States Patent
Kittrick et al.

(10) Patent No.: US 8,397,919 B2
(45) Date of Patent: Mar. 19, 2013

(54) CONTINUOUS GRAVITY ASSISTED ULTRASONIC COAL CLEANER

(76) Inventors: Bruce H. Kittrick, Redding, CA (US); Douglas C. McHaney, Redding, CA (US)

( * ) Notice: Subject to any disclaimer, the term of this patent is extended or adjusted under 35 U.S.C. 154(b) by 425 days.

(21) Appl. No.: 12/724,720

(22) Filed: Mar. 16, 2010

(65) Prior Publication Data

US 2010/0230329 A1 Sep. 16, 2010

Related U.S. Application Data

(60) Provisional application No. 61/160,388, filed on Mar. 16, 2009.

(51) Int. Cl.
*B07B 13/00* (2006.01)

(52) U.S. Cl. ..... 209/659; 209/3; 209/10; 209/17; 209/172; 209/541

(58) Field of Classification Search ..... 209/3, 10, 209/17–18, 44, 172–174, 437, 659; 210/748.05
See application file for complete search history.

(56) References Cited

U.S. PATENT DOCUMENTS

| | | | | | |
|---|---|---|---|---|---|
| 2,332,506 | A | * | 10/1943 | Curtis | 209/541 |
| 2,907,455 | A | | 10/1959 | Sasaki | |
| 3,250,016 | A | * | 5/1966 | Agarwal | 34/371 |
| 3,577,337 | A | | 5/1971 | Kessler et al. | |
| 3,979,205 | A | * | 9/1976 | Wanzenberg | 75/10.19 |
| 4,156,593 | A | | 5/1979 | Tarpley, Jr. | |
| 4,194,922 | A | * | 3/1980 | Gransell et al. | 134/1 |
| 4,391,608 | A | | 7/1983 | Dondelewski | |
| 4,412,842 | A | | 11/1983 | Klayer | |
| 4,529,506 | A | | 7/1985 | Smit | |
| 4,537,599 | A | | 8/1985 | Greenwald, Sr. | |
| 4,741,839 | A | * | 5/1988 | Morton et al. | 210/748.05 |
| 4,919,807 | A | | 4/1990 | Morton et al. | |
| 4,964,576 | A | | 10/1990 | Datta | |
| 5,087,379 | A | * | 2/1992 | Morton et al. | 210/748.05 |
| 5,577,669 | A | * | 11/1996 | Vujnovic | 241/1 |
| 5,613,997 | A | * | 3/1997 | Satchell, Jr. | 75/414 |
| 5,780,747 | A | * | 7/1998 | Soo | 73/861.29 |
| 5,947,299 | A | | 9/1999 | Vazquez et al. | |
| 5,951,456 | A | * | 9/1999 | Scott | 516/195 |
| 2006/0280669 | A1 | * | 12/2006 | Jones | 423/445 R |

FOREIGN PATENT DOCUMENTS

| | | |
|---|---|---|
| JP | 57-019229 | 2/1982 |
| JP | 60-006789 | 1/1985 |

* cited by examiner

*Primary Examiner* — Terrell Matthews
(74) *Attorney, Agent, or Firm* — Lowry Blixseth LLP; Scott M. Lowry

(57) ABSTRACT

An improved system and method for separating combustible organic particles from noncombustible inorganic particles in coal, in preparation for combustion. The coal is size-reduced and size-graded to small pieces which are then supplied to input ends of water-immersed descending slides having ultrasonic transducers for vibratory separation of inorganic and organic particles. The slides have different longitudinal lengths with angles of declination configured to achieve time-differential exposure to the ultrasonic vibratory energy, with smaller coal pieces being subjected to shorter time ultrasonic vibratory exposure. In one preferred form, longitudinally spaced turbidity sensors along the slide provide signals used to control selected ultrasonic transducers upon substantially complete cleaning of the coal pieces.

56 Claims, 6 Drawing Sheets

CONTINUOUS GRAVITY ASSISTED ULTRASONIC COAL CLEANER

BACKGROUND OF THE INVENTION

This invention relates generally to an improved system and method for cleaning of coal. More specifically, this invention relates to improved separation of carbon-based or organic combustible particles or matter comprising vegetation and the like, from suspended and substantially noncombustible inorganic particles or matter, such as clay particles and the like.

Coal deposits are generally defined as carbonized vegetation matter which, due to the effects of heat and pressure over a prolonged period of time, becomes compressed into a rock-like dark material which is combustible to provide a common fuel source used widely in various industrial applications, such as electrical generation plants and the like. In use, the coal is mined from the earth, and typically reduced in size as by grinding for subsequent combustion within a large firebox or the like. In a typical electrical generation facility, the heat generated by the combusted coal is used to heat water sufficiently to provide a source of steam used to drive appropriate steam-powered generators.

In a raw or as-mined state, coal deposits normally include a minor proportion of noncombustible inorganic matter, particularly such as clay particles, ash, sand, rock fragments, and the like, which are mixed into the carbon-based organic matter. This inorganic matter occurs naturally in the course of primordial formation of the coal deposits, due to sporadic flooding and other natural phenomena which inherently combines such inorganic matter with the organic matter. Upon subsequent coal combustion, this entrained or embedded inorganic matter is substantially noncombustible, and thereby melts within the firebox to rob heat from the combusted organic coal particles. While such inorganic particles can be removed from post-combustion flue gases by means of electrostatic precipitation or the like, there is nevertheless a significant reduction in the total combustion output energy of the combusted organic coal particles.

Mercury particulate and the resultant flue gas contaminant represent an especially problematic inorganic constituent in some mined coals. In recent years, governmental regulations have applied pressure to the coal industry to effectively remove such mercury particulate from mined coal, prior to combustion in a firebox.

In the past, a variety of systems and methods have been proposed for separating the noncombustible inorganic matter or particles from the combustible organic carbon-based coal matter or particles. Such systems and methods have generally comprised initial crushing of mined coal to a relatively small and preferably powder-like constituency, followed by passing the small powder-like coal through a vibratory conveyor for recovering separated inorganic minerals from the otherwise combustible carbon-based coal component. More recently, improved systems and methods have used ultrasonic vibration. See, e.g., U.S. Pat. No. 4,741,839 which discloses a ground coal powder delivered as a water-borne slurry along a descending vibrator tray activated by multiple ultrasonic transducers used to separate the inorganic matter from the carbon-based organic matter. Different densities of the physically separated but still inter-mixed inorganic particles vs. organic particles permits subsequent settling and/or centrifugal separation to recover the valuable organic matter for drying, and subsequent combustion, as well as removal of an undesired inorganic component.

The descending ultrasonically vibrated conveyor, however, requires pre-crushing or pre-grinding of mined coal chunks substantially into a powder form to provide the requisite water-borne slurry. Such grinding of the mined coal chunks to a powder form is a mechanically intensive process, with the incumbent wear and maintenance/replacement of components.

There exists, therefore, a significant need for an improved ultrasonic system and method for separating mined coal into noncombustible inorganic matter and combustible organic matter, prior to supplying the comparatively softer organic matter to a firebox for combustion, while substantially reducing and/or eliminating the maintenance-intensive process of pre-crushing or pre-grinding the mined coal in preparation for ultrasonic separation. The present invention fulfills these needs and provides further related advantages.

SUMMARY OF THE INVENTION

In accordance with the invention, an improved system and method are provided for separating combustible organic particles from noncombustible inorganic particles in coal, preparatory to combustion. The coal is size-reduced and size-graded to pieces which are then supplied to input ends of water-immersed descending slides having ultrasonic transducers for vibratory separation of inorganic and organic particles. The slides have different longitudinal lengths and are optionally angularly adjustable for selected time-differential exposure to the ultrasonic vibratory energy, with smaller coal pieces being subjected to shorter time ultrasonic vibratory exposure. In one preferred form, longitudinally spaced turbidity sensors along the slide provide signals used to deactivate or otherwise regulate or control selected ultrasonic transducers upon substantially complete cleaning of the coal pieces.

Mined coal is initially crushed or ground to smaller pieces, preferably on the order of about 0.5 inch or less, and then supplied to the upper input ends of the descending slides. Each slide has a longitudinal length which differs according to the sizes of the coal pieces inputted thereto, with smaller-sized pieces being supplied to a shorter-length slide, and vice versa. A preferred embodiment utilizes three different descending slides of different longitudinal lengths, with each slide comprising a chute having a closed geometry defined by top, bottom and a pair of side walls. Each chute is angularly adjustable for selection of a unique or specific declination angle, typically ranging from about 30 to about 85 from a horizontal plane, and tapers downwardly with a diverging or expanding geometry. Coal jamming in each chute is prevented and/or relieved by upward backflushing, either by a high flow through the entire slide/chute assembly, or by use of one or more upwardly angled high-flow flushing jets.

Water is supplied to each slide chute in a counter-current or upward direction opposite to the gravity-falling coal pieces therein, or alternately in a forward-current or downward direction therein. Operation of the ultrasonic transducers provides ultrasonic vibratory energy which effectively separates the inorganic and organic constituents. Thereafter, the cleaned coal is dried and ready for combustion in a firebox or the like.

The water used to clean the coal pieces travels with the fluidized particulate, primarily inorganic particulate, to a treatment step for cleaning and, in the preferred form, recycling. One such treatment step includes a cyclone for separating any residual powder-like coal fines from the inorganic particles.

In accordance with one aspect of the invention, each slide further includes at least one and preferably a plurality of turbidity sensors mounted at longitudinally spaced positions along the descending slide. These turbidity sensors provide water clarity signals representative of local water turbidity, wherein these signals are used for automatic or manual modulation control or deactivation of selected ultrasonic transducers in the event that the turbidity sensor signal indicate substantially complete cleaning of the coal pieces. In this regard, the separated noncombustible inorganic matter or particles tends to obscure and cloud the water in the immediate vicinity of the separation event. The multiple turbidity sensors provide longitudinally spaced differential readings which, if continuing to increase along the slide length, indicate that inorganic/organic matter separation is still occurring. In the event that successive turbidity sensors do not detect increases in water turbidity indicative of on-going separation of the inorganic/organic matter, then the resultant signals indicate that subsequent, or one or more of the ultrasonic transducers can be reduced in power or otherwise turned off to save energy. Alternately, in the event that the turbidity signal or signals indicate relatively low water turbidity, the ultrasonic transducers can be modulated for increased power to increase cleaning of the coal pieces.

Other features and advantages of the present invention will become apparent from the following more detailed description, when taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
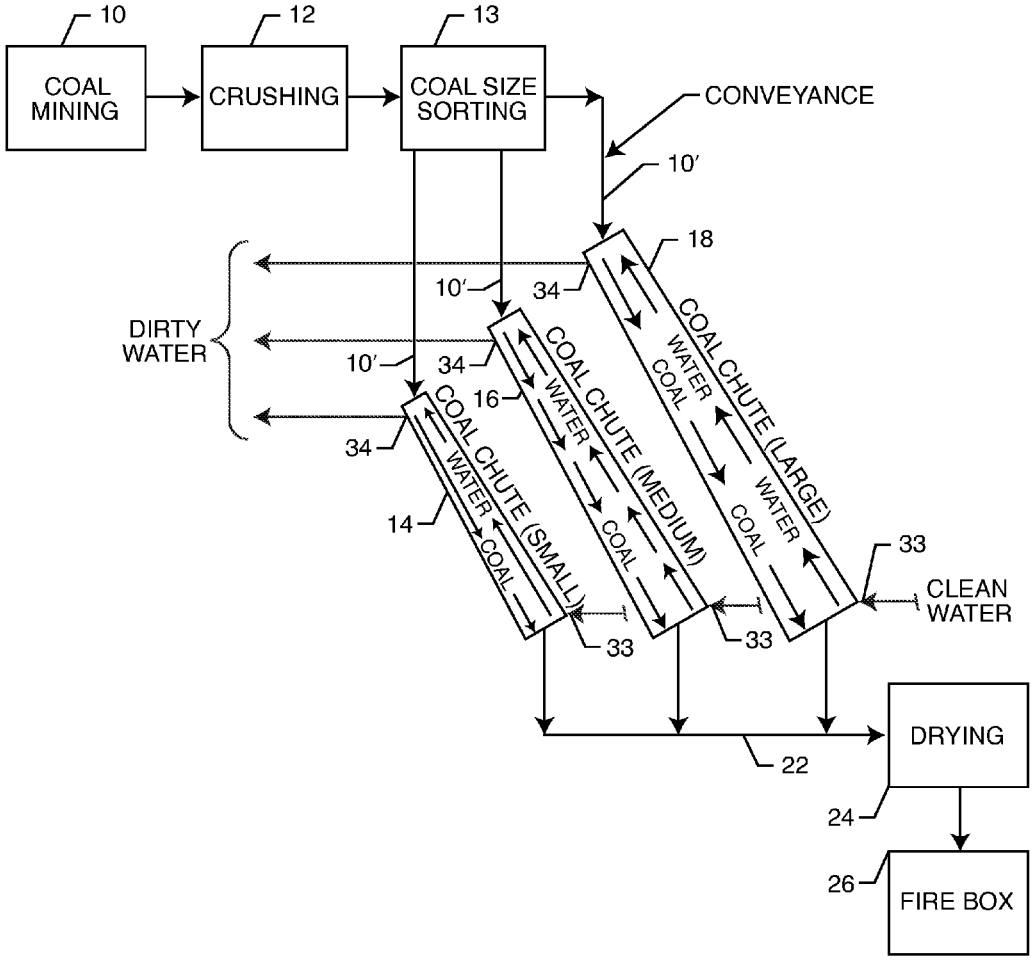
FIG. 1 is a schematic diagram illustrating the system and method of the present invention.
Figure 2:
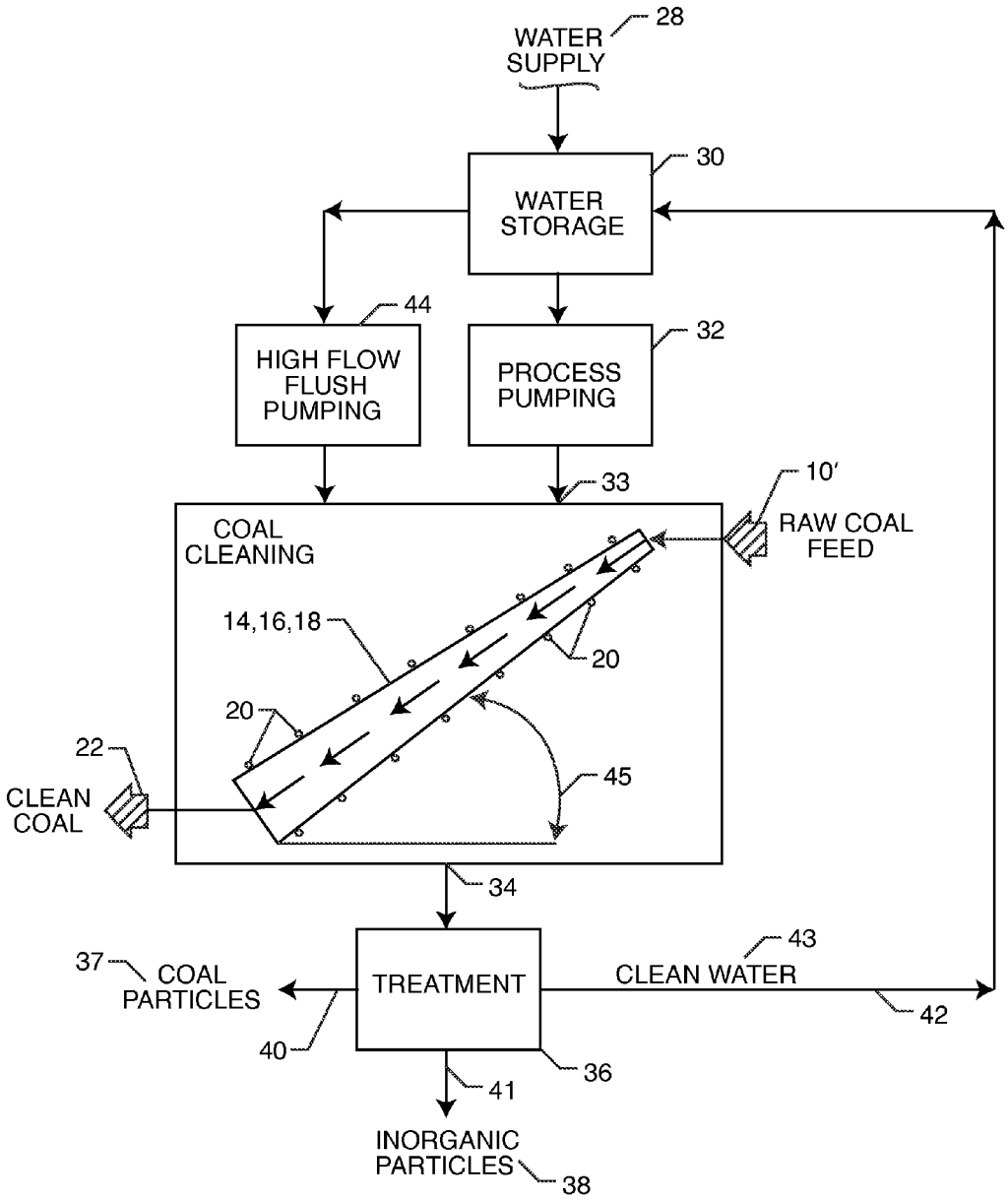
FIG. 2 is a further schematic diagram illustrating further aspects of the system and method of the present invention.

The present invention relates generally to an improved production system and method for separating combustible organic matter or particles from noncombustible inorganic matter, such as clay particles and the like, from coal preparatory to combustion of the coal in a suitable firebox. As shown generally in FIGS. 1 and 2, raw mined coal referred to generally by the reference numeral 10 is initially crushed or ground by means of a conventional crusher 12 or the like, and then size-graded as indicated by reference numeral 13 into multiple different sizes 10' such as the illustrative small, medium and large. The size-graded coal pieces 10' (FIG. 2) are then conveyed to the upper ends of suitable descending slides 14, 16 and 18 (as shown in FIG. 1) for water-washing in the presence of ultrasonic energy provided by multiple ultrasonic transducers 20 (FIG. 2). The cleaned coal 22 is discharged from the lower ends of the slides 14, 16 and 18 for transport as by means of an auger (not shown) or the like for suitable drying in a dryer 24 (FIG. 1), followed by combustion in a firebox 26 or the like.

FIG. 2 shows the water circulation process applicable to each of the descending slides 14, 16 and 18. In particular, water from a suitable water supply 28 is initially stored in a water tank 30 or the like. This water from the tank 30 is pumped as indicated by reference numeral 32 to a intake supply manifold 33 associated with each of the slides 14, 16 and 18 (as will be described herein in more detail) to clean, in association with the ultrasonic transducers 20, the coal pieces 10'. Prior to pumping to the slides 14, 16 and 18, the water can be degassed (not shown) for improved ultrasonic separation of the inorganic constituent. The cleaned coal 22 is discharged from the lower end of the associated slide 14, 16 or 18, whereas the now-dirty water comprising primarily the fluidized inorganic particulate (with some powder-like entrained coal fines) is discharged separately via a discharge manifold 34 to an appropriate treatment step 36. Persons skilled in the art will recognize and appreciate that this treatment step 36 and associated equipment may take different forms, such as a cyclone, settling pond, filtration unit, and/or a suitable chemical treatment unit, or the like. In any case, the treatment step 36 and associated equipment separates residual powder-like coal fines and particulate 37 from the predominantly inorganic particulate 38 from the water for separate output as indicated in FIG. 2 by lines 40, 41 and 42. As shown, the cleaned water 43 can be recycled via line 42 to the storage tank 30.

Figure 7:
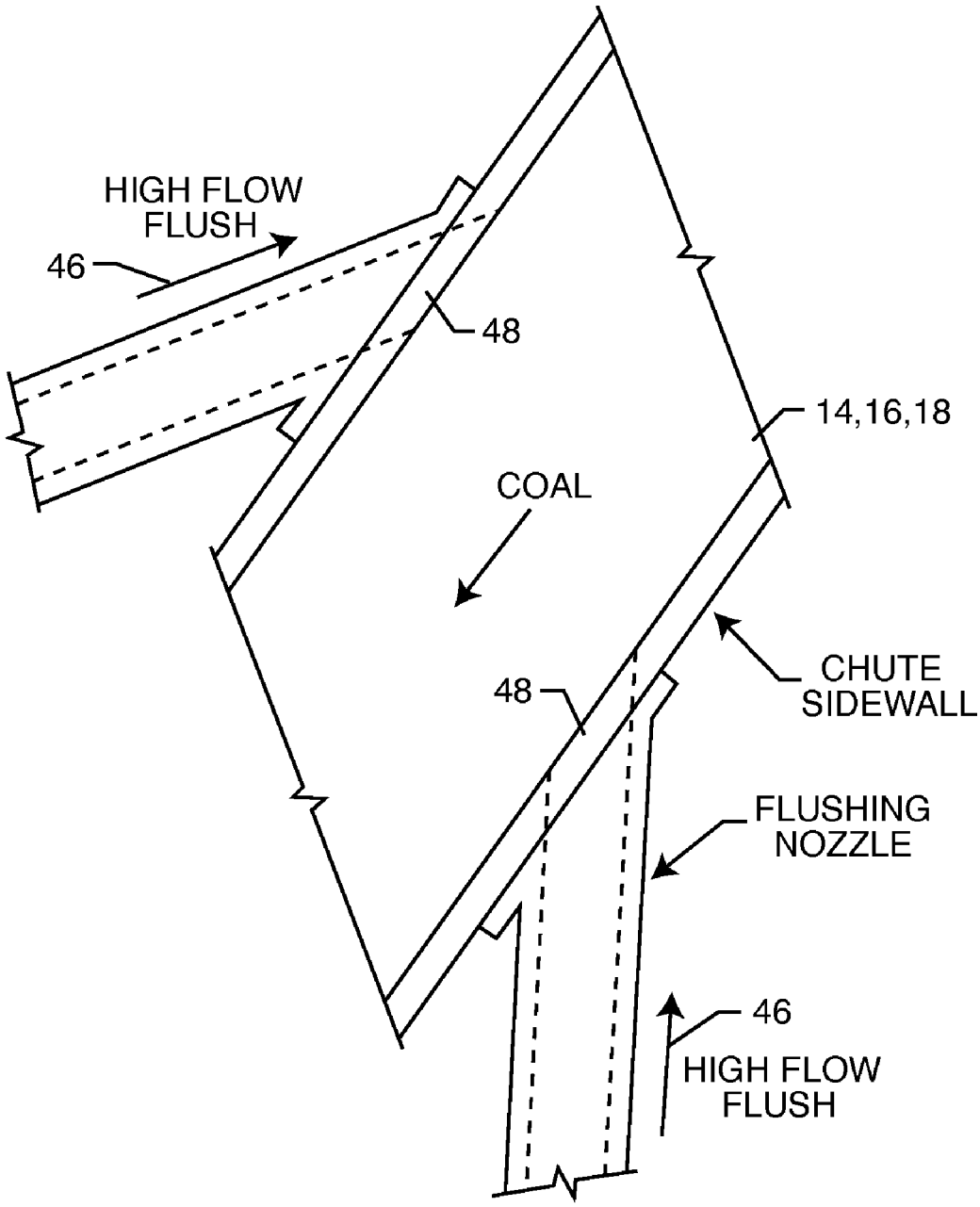
FIG. 7 is a schematic diagram illustrating a flush flow nozzle for use in the invention.

As further illustrated in FIG. 2, water from the storage tank 30 may also be supplied to a high flow flush pumping apparatus indicated by reference numeral 44. This high flow flush pumping apparatus 44 beneficially supplies a flushing water flow 46 (FIG. 7) to the slide 14, 16, 18 in its entirety, or alternately to one or more upwardly angled flush flow nozzles 48 disposed at or near the lower end of each descending slide 14, 16 and 18. The nozzles 48 each provide a counter-current and high pressure localized water stream that acts to mix and stir the water and coal pieces within each descending slide sufficiently to prevent jamming therein. Undesirable jamming is further reduced by forming each of the descending slides 14, 16 and 18 to have a slightly expanding or diverging cross sectional size and shape in a downward direction, as shown in FIGS. 1 and 2.

Figure 3:
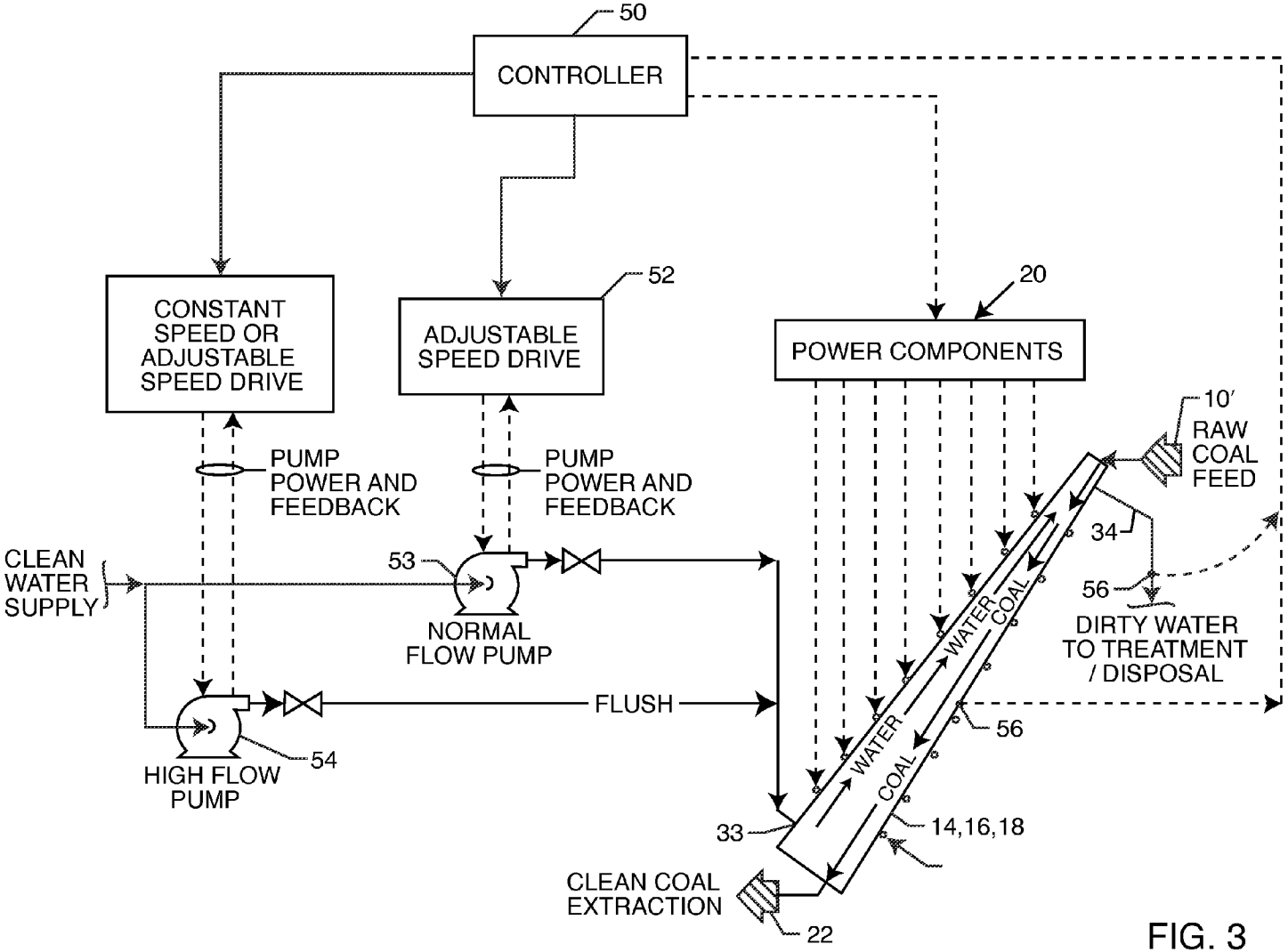
FIG. 3 is a schematic diagram illustrating counter-current water supply to an exemplary descending slide to clean coal pieces.
Figure 4:
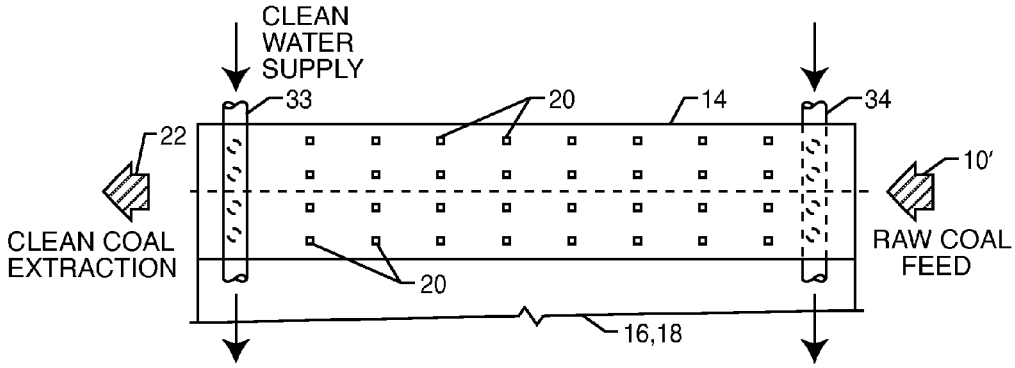
FIG. 4 is a schematic diagram illustrating the descending slide in top plan view.

FIGS. 3-4 show an exemplary descending slide 14, 16 or 18 in more detail, relative to the ultrasonic transducers 20 and the water supply equipment. In a preferred embodiment, each slide comprises a chute or chute-like construction having a closed geometry defined by top, bottom and a pair of side walls. As shown in FIG. 2 by reference numeral 45, the descending slide 14, 16 or 18 is angularly oriented at a desired, adjustable descending or declination angle according to the size of inputted coal pieces 10', the desired coal mass flow rate, and the amount of anticipated inorganic matter to be cleaned from the inputted coal pieces 10'. Such adjustment and selection of the particular slide angle, in combination with the longitudinal slide length, determines the practical time-exposure to ultrasonic vibration energy. That is, where more cleaning of the inputted coal pieces 10' is desired, the declination angle of the descending slide will be decreased. In a typical orientation, the declination angle of the descending slide will be set within a range of from about 45 to about 80 from a horizontal plane. In a most preferred form of the invention, the specific declination angle for each of the chutes/slides 14, 16 and 18 will be optimized and then fixed for maximum removal of inorganic particles from the material being processed. Manual or automatic adjustment of the specific declination angles may also be employed to account for short term and long term variations in the fuel supply. The sorting process 13 will deliver the smaller size-graded coal pieces to the shorter slide 14, whereas progressively larger-sized coal pieces will be delivered to the longer slides 16 and 18, respectively.

In this regard, in one preferred form of the invention, the grinding or crushing step 12 (FIG. 1) reduces the sizes of inputted coal chunks from a raw mined state typically comprising chunks up to about 6 inches in size, to a useful size applicable to the cleaning system and method of the present invention. In a preferred form, the crushing equipment 12 reduces the sizes of the mined coal pieces 10 to about 0.5 inches or less, thereby minimizing the average distance between embedded inorganic particles and the surface of the associated coal piece 10'. Thereafter, the ground or crushed coal pieces 10' are size-graded for supplying respectively to the different-length and/or different-angled slides 14, 16 and 18, as shown in the exemplary drawings. In this regard, small powder-like coal pieces 10' will be supplied to the smallest slide 14, with larger-sized coal pieces 10' supplied to the largest, longest slide 18, and intermediate-sized pieces supplied to the intermediate slide 16. Optionally, this crushing step 12 may include preliminary coal exposure to a cryogenic temperature, such as by exposure to a liquid nitrogen bath (not shown) to increase the presence of microscopic cracks and crevices in the coal chunks, for subsequent improved ultrasonic separation of embedded inorganic particulate.

A controller 50 regulates operation of the system and method. As viewed in FIG. 3, the controller 50 operates the pumping system 32 via an adjustable speed drive 52 or the like to drive a water flow pump 53 used to supply a flow of clean water to the associated descending slide 14, 16 or 18. The specific flow rates are a function of the scale of the process, the cross-sectional areas of the chute-like slides 14, 16 and 18, the specific number of the chute-like slides in service, whether the application is a forward-current or a counter-current design, and the specific characteristics of the coal being processed. FIG. 3 shows this water supply from the pump 53 to an intake manifold 33 disposed at or near a lower end of the descending slide for counter-current water flow in a generally upward direction within the slide, opposite to the downward gravity-induced flow of the coal pieces 10' through the slide. During this counter-current water-coal flow through the descending slide, the controller 50 activates multiple ultrasonic transducers 20 disposed in close association with the slide. FIG. 3 shows an exemplary total of 16 different ultrasonic transducers disposed in longitudinally spaced rows of 8 each along the upper and lower sides of each descending slide 14, 16 or 18, wherein persons skilled in the art will recognize and appreciate that this arrangement and number of ultrasonic transducers is representative and may be subject to different arrangements and/or different numbers according to the characteristics of the coal being cleaned and the specific geometries and/or numbers of the chute-like slides. The controller 50 is operable to activate these transducers 20 to produce ultrasonic vibratory energy at a specific and variable frequency chosen for best cleaning of the coal pieces 10', with a typical ultrasonic frequency ranging from about 20 kilohertz to about 80 kilohertz, and more preferably about 40 kilohertz. Accordingly, as the coal pieces 10' travel downwardly along the descending slide 14, 16 or 18, the coal is progressively cleaned, whereas the upward traveling or counter-current water flow becomes progressively dirtier. This now-dirty water flow exits from near the upper end of the descending slide 14, 16 or 18 via the discharge manifold 34 for suitable treatment and cleaning (as viewed in FIG. 2).

The ultrasonic transducers 20 are frequency selected to the characteristics of the inorganic particles, such as clay, within the coal pieces 10'. The ultrasonic vibration energy is believed to produce pressure waves of sufficient magnitude to cause multiple cavitation sites within the coal pieces resulting in a cavitation bubble that collapses substantially immediately. The result is that these cavitation sites in the water form adjacent to the inorganic particles to provide the impetus to effectively expel the inorganic particles through the interstices and microscopic channels of the coal pieces for separation. In this regard, the cavitation sites are believed to nucleate from the boundary between the organic vs. the inorganic particles within the coal 10'.

Persons skilled in the art will recognize and appreciate that the ultrasonic transducers 20 have a conventional known construction. Exemplary ultrasonic transducers 20 are available from Crest Ultrasonic Corporation, Trenton, N.J., in immersible arrangements.

If and when needed, the controller 50 additionally operates the high flow pumping system 44 (FIG. 2) by actuating a high flow pump 54 (FIG. 3) to supply the flush nozzles 48 at or near the bottom of each descending slide 14, 16 or 18, for effectively providing a high pressure water jet or jets into the slide interior in an upwardly angled or counter-current direction to achieve thorough mixing of the coal pieces 10 within the supplied water. This water jet or jets beneficially prevent the gravity-falling coal pieces 10 from jamming or otherwise obstructing the lower outlet end of the descending slide. Such jamming is further deterred by forming each descending slide 14, 16 or 18 to have a downwardly expanding or diverging shape which becomes progressively larger in cross section toward the lower end thereof. FIG. 3 shows a counter-current embodiment wherein the pumps 53 and 54 both supply water to the nozzles 48, whereas FIG. 5 shows a forward-current embodiment wherein the high flow pump 54 supplies the flushing water flow to the nozzles 48.

In accordance with one further aspect of the invention, each of the descending slides 14, 16 and 18 is also provided with at least one and preferably multiple turbidity sensors 56 mounted at longitudinally spaced positions along the descending lengths thereof. These turbidity sensors 56 provide water turbidity or water clarity readings linked to the controller 50, wherein the controller 50 responds to these turbidity-indicative readings to control the ultrasonic transducers 20 in accordance therewith. That is, the turbidity readings, such as turbidity readings provided by two consecutive turbidity sensors 56 indicate progressively dirtier water, or progressive decrease in water clarity, then the controller 50 can be operated to modulate or control the remaining ultrasonic transducers 20 to continue cleaning inorganic particles from the coal pieces 10'. However, in the event that the turbidity reading or readings as provided, e.g., by consecutive turbidity sensors 56, indicates a minimal or no change in water dirtiness, then the controller 50 can be operated to modulate or turn off subsequent ultrasonic transducers 20 as unnecessary energy usage. As a further alternative, depending upon the characteristics of the coal being cleaned, a turbidity reading may result in controller operation to increase power to subsequent ultrasonic transducers 20. Alternatively, selected ones of the ultrasonic transducers 20 can be manually modulated or turned off by a system operator in response to the signals from the turbidity sensor or sensors 56.

While FIG. 3 shows two turbidity sensors 56, persons skilled in the art will recognize and appreciate that additional turbidity sensors 56 may be used, as desired. Persons skilled in the art will also understand that the construction and operation of such turbidity sensors 56 are conventional. Exemplary turbidity sensors 56 are available from HACH Company, Loveland, Colo., under model designation Solitax.

Figure 6:
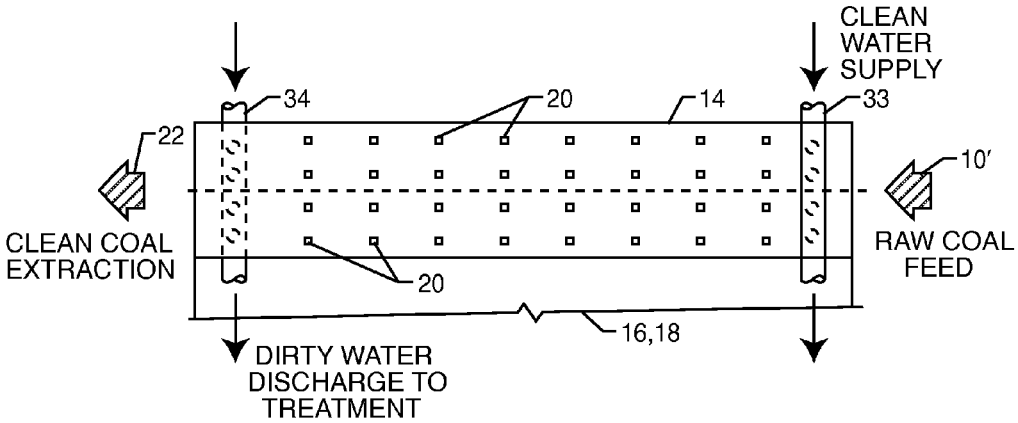
FIG. 6 is a schematic diagram illustrating the descending slide of FIG. 5 is top plan view.
Figure 5:
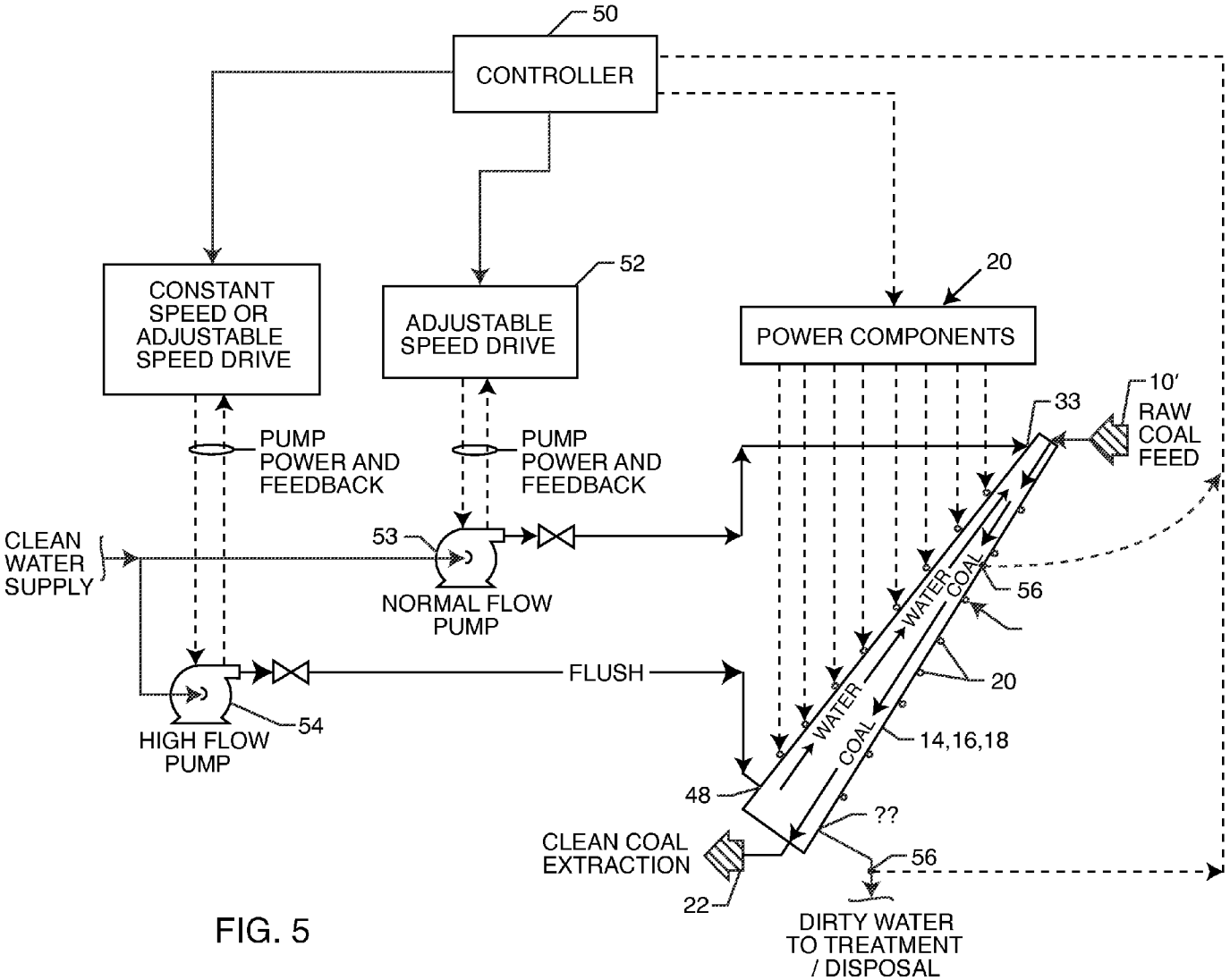
FIG. 5 is a schematic diagram similar to FIG. 3, but showing forward-current water supply to the exemplary descending slide to clean coal pieces.

FIGS. 5-6 illustrate an alternative preferred form of the invention, differing from FIGS. 3-4 in that the water supplied to each descending slide 14, 16 or 18 is provided in a forward-current direction at or near the upstream end of the slide, along with the coal pieces 10. That is, the clean water is pumped to the intake manifold 33 disposed at or near the upstream end of the slide 14, 16 or 18, and dirty water is removed from the slide for cleaning via the discharge manifold 34 disposed at or near the side lower or downstream end. All other aspects of the cleaning system and method, inclusive of the ultrasonic transducers 20, the controller 50, and the turbidity sensors 56, remain the same. Moreover, FIG. 5 shows the flush nozzle 48 mounted at or near the lower or downstream end of the descending slide 14, 16 or 18 for flush-flow (FIG. 7) to prevent undesired jamming. Persons skilled in the art will understand that additional and/or alternative locations for the flush nozzle or nozzles 48 may be employed.

Persons skilled in the art will recognize and appreciate that the use of multiple descending slides 14, 16 and 18 as shown can be provided in any desired multiple number, and/or that the multiple descending slides can be replaced by a single descending slide that is laterally angled to provide steeper vs. shallower slide paths for the size-graded coal pieces in varying time-exposure to the ultrasonic vibratory energy produced by the multiple ultrasonic transducers.

In accordance with further aspects of the invention, it will be understood that various salts and/or wetting agents may be added to the water for enhancing the ability of the water to soak through microscopic cracks, channels and crevices in the coal pieces to improve ultrasonic separation of inorganic particulate from the combustible organic constituent.

A variety of further modifications and improvements in and to the improved system and method of the present invention will be apparent to those skilled in the art. Accordingly, no limitation on the invention is intended by way of the foregoing description, except as set forth in the appended claims.

What is claimed is:

1. A process for separating inorganic particles from organic material in mined coal, said process comprising the steps of:

size-grading and separating the mined coal into a plurality of different sizes;

supplying the sized-graded coal separately to the upper end of descending slide means associated with a plurality of ultrasonic transducers, said slide means being oriented for different time-exposure of the coal supplied thereto to ultrasonic vibration from said ultrasonic transducers;

supplying water to said descending slide means to immerse the size-graded coal supplied thereto, whereby the ultrasonic vibration from said ultrasonic transducers produces cavitation-induced separation of inorganic particles from organic material; and drying the organic material prior to combustion.

2. The process of claim 1 wherein said step of supplying the sized-graded coal separately to said descending slide means comprises supplying the size-graded coal to upper ends of each of a plurality of descending slides each associated with a plurality of ultrasonic transducers, each of said plurality of descending slides oriented for different time-exposure of the coal supplied thereto to ultrasonic vibration from said ultrasonic transducers, and further wherein said step of supplying water to said descending slide means comprises supplying water to each of said descending slides.

3. The process of claim 1 further comprising the step of cycling the water with entrained inorganic particles to a separator for separation thereof, and recycling the water from the separator to said descending slide means.

4. The process of claim 3 wherein said separator comprises a cyclone.

5. The process of claim 2 further comprising the step of angularly orienting each of said descending slides at an adjustable, different descending angle, said coal supplying step comprising supplying smaller size-graded coal to one of said slides set at a steeper descending angle.

6. The process of claim 2 wherein said water supplying step includes the step of supplying water generally to a lower end of each of said slides, and collecting the supplied water generally at an upper end of each of said slides.

7. The process of claim 2 wherein said water supplying step includes the step of supplying water generally to an upper end of each of said slides, and collecting the supplied water generally at a lower end of each of said slides.

8. The process of claim 2 further including the step of at least periodically providing a relatively high flow rate and high pressure flushing flow directed generally upwardly within said slide.

9. The process of claim 2 further including the step of forming each of said slides to have a generally chute construction defined by a pair of side walls respectively interconnected between a pair of top and bottom walls, said chute construction having a downwardly diverging tapered shape whereby the lower end defines a larger area that said upper end.

10. The process of claim 1 further comprising the step of reducing the size of the mined coal to chunks of about 0.5 inch or less prior to said size-grading step.

11. A system for separating inorganic particles from organic material in mined coal, said system comprising:

means for size-grading and separating the mined coal into a plurality of different sizes;

a plurality of descending slides each associated with a plurality of ultrasonic transducers and each oriented for different time-exposure of the coal supplied thereto to ultrasonic vibration from said ultrasonic transducers;

means for supplying the sized-graded coal separately to the upper ends of each of said slides;

means for supplying water to each of said descending slides to immerse the size-graded coal supplied thereto, whereby the ultrasonic vibration from said ultrasonic transducers produces cavitation-induced separation of inorganic particles from organic material; and a dryer for drying the organic material prior to combustion.

12. The system of claim 11 further comprising crusher means for reducing the chunk size of the coal to a size of about 0.5 inch or less prior to said means for size-grading and separating the coal.

13. The system of claim 11 further comprising separator means for cleaning entrained inorganic particles, and for recycling the cleaned water to the descending slides.

14. The system of claim 13 wherein said separator means comprises a cyclone.

15. The system of claim 11 wherein each of said descending slides is separately angularly adjustable to a different descending angular orientation, and further wherein said coal supplying means comprises means for supplying smaller size-graded coal to one of said slides set at a steeper descending angle.

16. The system of claim 11 wherein said water supplying means comprises an intake manifold disposed generally at a lower end of each of said slides, and a discharge manifold disposed generally at an upper end of each of said slides.

17. The system of claim 11 wherein said water supplying means comprises an intake manifold disposed generally at an upper end of each of said slides, and a discharge manifold disposed generally at a lower end of each of said slides.

18. The system of claim 11 further comprising flushing means for at least periodically providing a relatively high flow rate and high pressure flushing flow directed generally upwardly within said slide.

19. The system of claim 11 wherein each of said slides has a generally chute construction defined by a pair of side walls respectively interconnected between a pair of top and bottom walls, said chute construction having a downwardly diverging tapered shape whereby the lower end defines a larger area that said upper end.

20. A process for separating inorganic particles from organic material in mined coal, said process comprising the steps of:

size-grading and separating the mined coal into a plurality of different sizes;

supplying the sized-graded coal separately to the upper end of descending slide means associated with a plurality of ultrasonic transducers, said slide means being oriented for different time-exposure of the coal supplied thereto to ultrasonic vibration from said ultrasonic transducers;

supplying water to said descending slide means to immerse the size-graded coal supplied thereto, whereby the ultrasonic vibration from said ultrasonic transducers effectively separates inorganic particles from organic material;

drying the organic material prior to combustion; and sensing water turbidity with at least one turbidity sensor disposed in association with said descending slide means, and responding to said water turbidity sensing step by controlling selected one of said ultrasonic transducers.

21. The process of claim 20 wherein said step of supplying the sized-graded coal separately to said descending slide means comprises supplying the size-graded coal to upper ends of each of a plurality of descending slides each associated with a plurality of ultrasonic transducers, each of said plurality of descending slides oriented for different time-exposure of the coal supplied thereto to ultrasonic vibration from said ultrasonic transducers, and further wherein said step of supplying water to said descending slide means comprises supplying water to each of said descending slides.

22. The process of claim 21 further comprising the step of angularly orienting each of said descending slides at an adjustable, different descending angle, said coal supplying step comprising supplying smaller size-graded coal to one of said slides set at a steeper descending angle.

23. The process of claim 20 further comprising the step of cycling the water with entrained inorganic particles to a separator for separation thereof, and recycling the water from the separator to said descending slide means.

24. The process of claim 23 wherein said separator comprises a cyclone.

25. The process of claim 20 wherein said responding step comprising automatically responding to a water turbidity signal provided by said at least one water turbidity sensor.

26. The process of claim 20 wherein said water supplying step includes the step of supplying water generally to a lower end of said slide, and collecting the supplied water generally at an upper end of said slide.

27. The process of claim 20 wherein said water supplying step includes the step of supplying water generally to an upper end of said slide, and collecting the supplied water generally at a lower end of said slide.

28. The process of claim 20 further including the step of at least periodically providing a relatively high flow rate and high pressure flushing flow directed generally upwardly within said slide.

29. The process of claim 20 further including the step of forming said slide to have a generally chute construction defined by a pair of side walls respectively interconnected between a pair of top and bottom walls, said chute construction having a downwardly diverging tapered shape whereby the lower end defines a larger area that said upper end.

30. The process of claim 20 further comprising the step of reducing the size of the mined coal to chunks of about 0.5 inch or less prior to said size-grading step.

31. A system for separating inorganic particles from organic material in mined coal, said system comprising:

means for size-grading and separating the mined coal into a plurality of different sizes;

a plurality of descending slides each associated with a plurality of ultrasonic transducers and each oriented for different time-exposure of the coal supplied thereto to ultrasonic vibration from said ultrasonic transducers;

means for supplying the sized-graded coal separately to the upper ends of each of said slides;

means for supplying water to each of said descending slides to immerse the size-graded coal supplied thereto, whereby the ultrasonic vibration from said ultrasonic transducers effectively separates inorganic particles from organic material;

a dryer for drying the organic material prior to combustion; and at least one turbidity sensor disposed in association with each of said descending slides, said turbidity sensor providing at least one water turbidity signal for use in controlling selected one of said ultrasonic transducers.

32. The system of claim 31 further comprising crusher means for reducing the chunk size of the coal to a size of about 0.5 inch or less prior to said means for size-grading and separating the coal.

33. The system of claim 31 further comprising separator means for cleaning entrained inorganic particles, and for recycling the cleaned water to the descending slides.

34. The system of claim 33 wherein said separator means comprises a cyclone.

35. The system of claim 31 wherein each of said descending slides is separately angularly adjustable to a different descending angular orientation, and further wherein said coal supplying means comprises means for supplying smaller size-graded coal to one of said slides set at a steeper descending angle.

36. The system of claim 31 further comprising a controller automatically responsive to said at least one water turbidity signal provided by said at least one water turbidity sensor for controlling selected one of said ultrasonic transducers.

37. The system of claim 31 wherein said water supplying means comprises an intake manifold disposed generally at a lower end of each of said slides, and a discharge manifold disposed generally at an upper end of each of said slides.

38. The system of claim 31 wherein said water supplying means comprises an intake manifold disposed generally at an upper end of each of said slides, and a discharge manifold disposed generally at a lower end of each of said slides.

39. The system of claim 31 further comprising flushing means for at least periodically providing a relatively high flow rate and high pressure flushing flow directed generally upwardly within said slide.

40. The system of claim 31 wherein each of said slides has a generally chute construction defined by a pair of side walls respectively interconnected between a pair of top and bottom walls, said chute construction having a downwardly diverging tapered shape whereby the lower end defines a larger area that said upper end.

41. A process for separating inorganic particles from organic material in mined coal, comprising the steps of:

supplying mined coal to a first end of a descending slide associated with a plurality of ultrasonic transducers selectively emitting ultrasonic vibrations, the slide comprising a generally elongated and enclosed housing;

supplying fluid to a second end of said descending slide, the fluid discharging the descending slide from the first end thereof;

immersing the mined coal in the fluid within the enclosed descending slide; and activating cavitation-induced separation of inorganic particles from organic material in the mined coal by transmitting ultrasonic vibrations through the fluid medium and mined coal immersed therein.

42. The process of claim 41 further comprising the step of sensing water turbidity with at least one turbidity sensor disposed in association with said descending slide, and responding to said water turbidity sensing step by controlling one of said ultrasonic transducers.

43. The process of claim 42 wherein said responding step comprises automatically responding to a water turbidity signal provided by said at least one water turbidity sensor.

44. The process of claim 43 wherein said responding step includes the step of adjusting the angular orientation of said descending slide.

45. The process of claim 41 including the step of cycling the fluid and entrained inorganic particles to a separator for separation thereof, and recycling the fluid from the separator to said descending slide.

46. The process of claim 41 wherein said supplying step includes the step of supplying fluid generally to said first end comprising a lower end of said descending slide and collecting the supplied fluid generally at said second end comprising an upper end of said slide.

47. The process of claim 46 including the step of periodically providing a relatively high flow rate and high pressure flushing flow directed generally upwardly within said slide.

48. The process of claim 46 wherein said slide includes a downwardly diverging tapered shape defining a larger lower end relative to said upper end of said slide.

49. A system for separating inorganic particles from organic material in mined coal, comprising:

a descending slide comprising a generally elongated and enclosed housing having a lower end and an upper end;

a plurality of ultrasonic transducers associated with said descending slide and configured to selectively emit ultrasonic vibrations; and a fluid supply conduit coupled to said lower end of said descending slide for supplying fluid thereto to immerse said mined coal in a fluid-based medium therein such that ultrasonic vibration from said ultrasonic transducers through the fluid-based medium produces cavitation-induced separation of inorganic particles from organic material.

50. The system of claim 49 further comprising at least one turbidity sensor disposed in association with said descending slide, said turbidity sensor providing at least one water turbidity signal for use in controlling at least one of said ultrasonic transducers.

51. The system of claim 50 further comprising a controller automatically responsive to said at least one water turbidity signal provided by said at least one water turbidity sensor for selectively controlling at least one of said ultrasonic transducers.

52. The system of claim 49 including a separator for cleaning entrained inorganic particles, and for recycling the cleaned fluid to the descending slide.

53. The system of claim 52 wherein said separator comprises a cyclone.

54. The system of claim 49 wherein said descending slide is angularly adjustable to a different descending angular orientation.

55. The system of claim 49 wherein said descending slide includes an intake manifold disposed generally at said lower end of said slide, and a discharge manifold disposed generally at said upper end of said slide.

56. The system of claim 49 including a dryer for drying the organic material prior to combustion.

* * * * *